US005955795A

United States Patent [19]

Beer

[11] Patent Number: 5,955,795

[45] Date of Patent: Sep. 21, 1999

[54] APPARATUS FOR ENCLOSING APPLIANCES

[76] Inventor: David W. Beer, 1490 Spring Valley Rd., Bethlehem, Pa. 18015

[21] Appl. No.: 08/959,086

[22] Filed: Oct. 28, 1997

Related U.S. Application Data

[60] Provisional application No. 60/029,357, Oct. 28, 1996.

[51] Int. Cl.[6] ..... H05B 3/68; H01H 35/00

[52] U.S. Cl. ..... 307/131; 307/139; 219/444; 312/223.1

[58] Field of Search ..... 219/444; 307/112, 307/125, 131, 139, 140, 147, 148, 149; 312/223.1, 236

[56] References Cited

U.S. PATENT DOCUMENTS

| | | | |
|---|---|---|---|
| 1,341,994 | 6/1920 | Nelson . | |
| 2,015,295 | 9/1935 | Steingruber | 219/37 |
| 2,695,352 | 11/1954 | Dekold . | |
| 2,850,613 | 9/1958 | McCormick . | |
| 2,866,956 | 12/1958 | Miller et al. . | |
| 2,882,382 | 4/1959 | Woxman . | |
| 2,897,330 | 7/1959 | Hopkins . | |
| 2,931,873 | 4/1960 | Lang . | |
| 3,221,137 | 11/1965 | Madden . | |
| 3,617,693 | 11/1971 | Shimosawa . | |
| 3,659,068 | 4/1972 | Duffner et al. . | |
| 3,740,513 | 6/1973 | Peters, Jr. et al. . | |
| 3,790,750 | 2/1974 | Giannini | 219/44 |
| 3,814,900 | 6/1974 | Frey et al. . | |
| 4,325,294 | 4/1982 | Hammond | 99/337 |
| 4,345,144 | 8/1982 | Bergquist | 219/413 |
| 4,349,713 | 9/1982 | Marsen . | |
| 4,398,651 | 8/1983 | Kumpfer . | |
| 4,403,942 | 9/1983 | Copenhaver . | |
| 4,588,047 | 5/1986 | de Reynal de Saint Michel . | |
| 4,663,508 | 5/1987 | Ishimura et al. . | |
| 4,755,647 | 7/1988 | Nishikawa et al. . | |
| 4,935,593 | 6/1990 | Nishikawa . | |
| 5,132,503 | 7/1992 | Lee . | |
| 5,209,373 | 5/1993 | Gondek et al. . | |
| 5,220,153 | 6/1993 | Malone et al. . | |
| 5,252,797 | 10/1993 | Komatsu . | |
| 5,258,595 | 11/1993 | Tanaka . | |
| 5,280,152 | 1/1994 | Lee | 219/10.493 |
| 5,280,157 | 1/1994 | Hornung . | |
| 5,293,020 | 3/1994 | Han et al. . | |
| 5,451,745 | 9/1995 | Goldberg et al. . | |

*Primary Examiner*—Jeffrey Gaffin
*Assistant Examiner*—Jonathan Kaplan
*Attorney, Agent, or Firm*—Dilworth & Barrese

[57] ABSTRACT

An apparatus for enclosing appliances includes an enclosure having an access member movable between an open configuration and a closed configuration. A power supply mechanism disposed within the enclosure and adapted to supply power to the appliance when the access member is in the open configuration and disconnect power to the appliance when the access member is in the closed configuration is also included. An access member locking mechanism is disposed within the enclosure which is operable between a locked condition to lock the access member in the open configuration in response to the operation of the appliance and a released condition to permit movement of the access member to the closed configuration.

18 Claims, 9 Drawing Sheets

RIGHT SIDE ELEVATION

SECTION

APPARATUS FOR ENCLOSING APPLIANCES

CROSS REFERENCE TO RELATED APPLICATION

This application claims priority to U.S. Provisional Application Ser. No.60/029,357 filed Oct. 28, 1996.

BACKGROUND OF THE INVENTION

1. Field of the Invention

The present disclosure relates to an apparatus for enclosing appliances. More particularly, the present disclosure relates to enclosures which enclose some or all of the operational components of the appliances when not in use while maintaining the functionality of the appliances.

2. Description of the Related Art

An appliance, e.g., a stove, refrigerator, or microwave oven, is often situated in full view in a kitchen or other room. As a result, the appliance may take away the ambience associated with a classical design due to the modern look of typical appliances. Kitchen designers, therefore, try to disguise dishwashers and refrigerators with wood panels, but dishwasher control panels, cooktops, ovens, microwave ovens and various refrigerator parts and multitudes of small appliances still compromise the intended look. Additionally, in small living spaces such as one bedroom apartments or studio apartments, it may be desirable to have the kitchen area blend into the remaining living space.

U.S. Pat. No. 2,015,295 to Steingruber discloses an electric stove designed to be mounted upon the sliding drawer of a table or cabinet. The stove is lifted from the drawer and set upon a table top or the like in order to be used. U.S. Pat. No. 2,931,873 to Lang discloses an electrical wall panel cooking unit that is maintained within a wall when not in use. One drawback of such previous devices is that there are no mechanisms for preventing the stove or cooking unit from being stored or recessed within the wall when the stove or cooking unit is operational or has not cooled sufficiently.

Therefore, a need exists to develop aesthetically pleasing enclosures for appliances that accommodate the functional considerations necessary to prepare food, without disturbing the appearance of a classical furniture design. It is an object of the present disclosure to enclose an appliance within an enclosure such that most, if not all control panels, cook tops, handles and other parts are hidden from view.

Further, it is an object of the present disclosure to provide an enclosure for an appliance while maintaining the functionality of the appliance and adhering to applicable safety considerations. Such safety considerations include providing a door locking mechanism to prevent the appliance from being completely enclosed when it is operational, or while it is cooling, if cooling is critical to the appliance's integrity.

These and other objects of the present disclosure will become more apparent with the following detailed description taken in conjunction with FIGS. 1A–5C.

SUMMARY

In a first embodiment, the present disclosure provides a novel apparatus which hides conventional appliances while permitting ready access to the appliance for the operation thereof. The presently disclosed apparatus does not require any alteration of the appliance, rather the apparatus merely provides an aesthetically pleasing enclosure for the appliance. The presently disclosed apparatus permits the enclosed appliance to function as designed, and when not in use, conceals the appliance from view. Apart from enclosing a particular appliance, the presently disclosed apparatus also provides an interface between the building's electrical outlet and the enclosed appliance in order to control power supplied to the appliance.

In one embodiment, the present disclosure provides an apparatus for enclosing appliances, which includes an enclosure having an access member movable between an open configuration and a closed configuration, a power supply mechanism disposed within the enclosure and adapted to supply power to the appliance when the access member is in the open configuration and disconnect power to the appliance when the access member is in the closed configuration, and an access member locking mechanism disposed within the enclosure which is operable between a locked condition to lock the access member in the open configuration in response to the operation of the appliance and a released condition to permit movement of the access member to the closed configuration.

The power supply mechanism may include at least one movable access member switch. The apparatus may include a plurality of movable access members, each having an associated movable access member switch in series such that when all moveable access members are in the open configuration power is supplied to the appliance.

In a further aspect of the present disclosure, an apparatus for enclosing appliances having at least one movable access member, is provided which includes at least one movable access member switch, a contactor for making at least one contact point to supply power to an appliance when the at least one movable access member is in an open configuration and disconnect power to the appliance when the at least one movable access member is in the closed configuration wherein the at least one movable access member switch is opened corresponding to the closed configuration and the at least one movable access member switch is closed corresponding to the open configuration, and a plate attached to the at least one movable access member for closing the at least one movable access member switch when the at least one movable access member is fully opened.

The apparatus may further include at least one enabling switch, and a locking mechanism having an actuation means for moving a locking device between a lock position when the at least one enabling switch is open and a release position when the at least one enabling switch is closed to respectively lock or release the at least one movable access member.

The apparatus may further include a current sensor for sensing current through a power line to the appliance such that if current is flowing, the actuation means maintains the locking device in the lock position. In one aspect of the present disclosure, the current sensor maintains the locking device in the lock position for a predetermined amount of time after the appliance is turned off.

The apparatus may further include a transformer for adjusting a voltage to the contactor and the current sensor.

In another alternative embodiment of the present disclosure a lock circuit for locking a movable access member on an enclosure is provided which includes at least one access member switch connecting between a power terminal and a contactor, the contactor for making at least one contact point when the a movable access member of an enclosure is closed, the at least one contact point connecting segments of a power line for supplying power to an appliance at least partially enclosed by the enclosure when the movable access member is closed, at least one enabling switch connecting between the power terminal and actuation means, the actuation means for moving a locking device between a lock position when the at least one enabling switch is opened and a release position when the at least one enabling switch is closed to respectively lock or release a movable access member, a current sensor for sensing current through the power line such that if current is flowing actuation means maintains the locking device in the lock position, and a plate attaching to the movable access member, the plate being configured and dimensioned to engage and close the at least one access member switch.

In one aspect, the current sensor maintains the locking device in the lock position for a predetermined amount of time after the appliance is turned off. In a further aspect of the apparatus, the locking device includes a shaft, the shaft configured and dimensioned to fit in a corresponding opening in the plate such that the shaft locks the movable access member in the fully opened position when actuated to move into the opening and the movable access member is released when the shaft is retracted.

DETAILED DESCRIPTION OF THE PREFERRED EMBODIMENTS

Figure 1B:
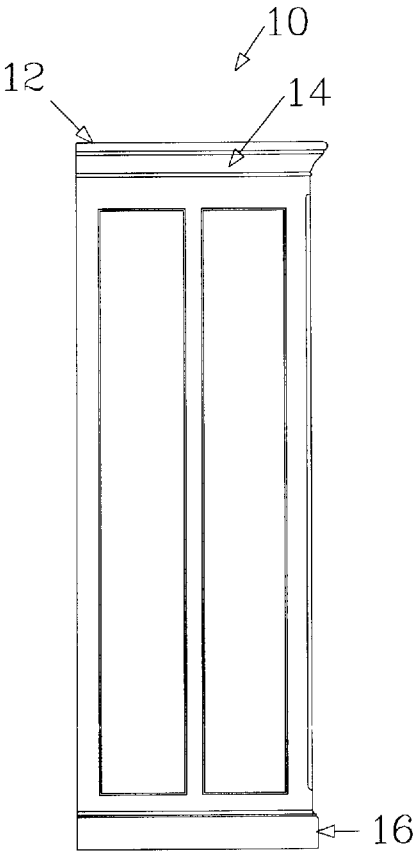
FIG. 1B is a side view of the apparatus for enclosing an appliance of FIG. 1A.

Preferred embodiments of the presently disclosed apparatus for enclosing appliances will now be described in detail with reference to the drawings, in which like reference numerals designed identical or corresponding elements in each of the several views.

While the preferred embodiments of the apparatus for enclosing appliances of the present disclosure will be described primarily with reference to an enclosure for enclosing kitchen appliances, it can be used or adapted for enclosing other appliances, such as stereo equipment, television, computer equipment, or medical equipment. As used in the present disclosure, the term enclosure includes structures which either partially or totally envelope an appliance.

Figure 1A:
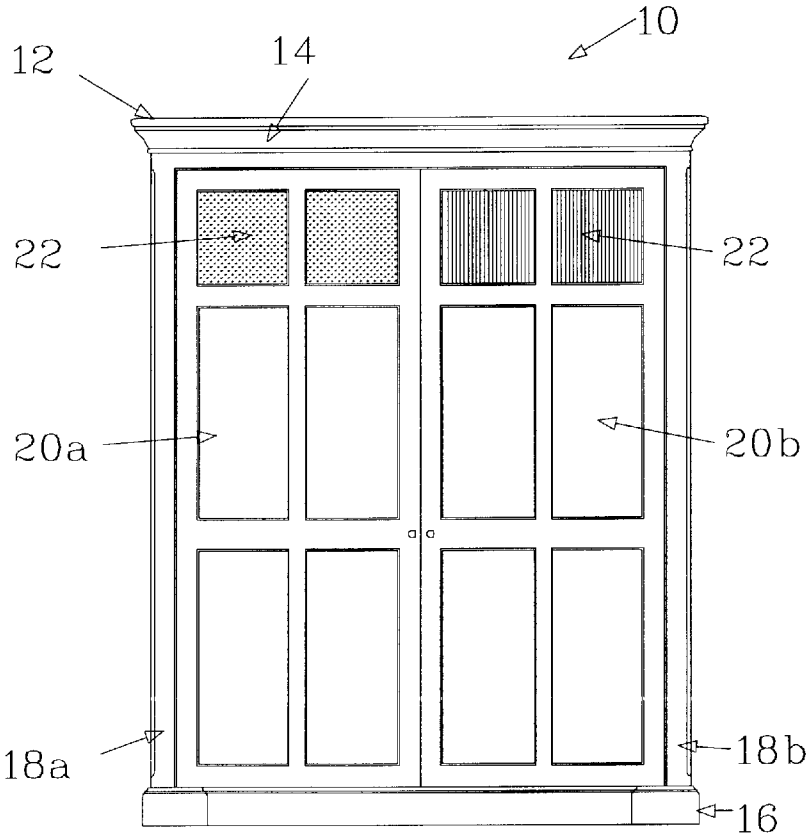
FIG. 1A is a front view of one illustrative embodiment of the presently disclosed apparatus for enclosing an appliance of the present invention.

FIGS. 1A and 1B illustrate one embodiment of the apparatus for enclosing an appliance shown generally as 10. Briefly, the apparatus 10 includes a cabinet frame 12 having cornice 14, base 16 and front pilasters 18*a* and 18*b*. Door panels 20*a* and 20*b* are attached to hardware within the cabinet frame 12 which allows the door panels 20*a* and 20*b* to open and close. An upper end of each door panel 20*a* and 20*b* includes two air vents 22, which may be of various designs.

Figure 2A:
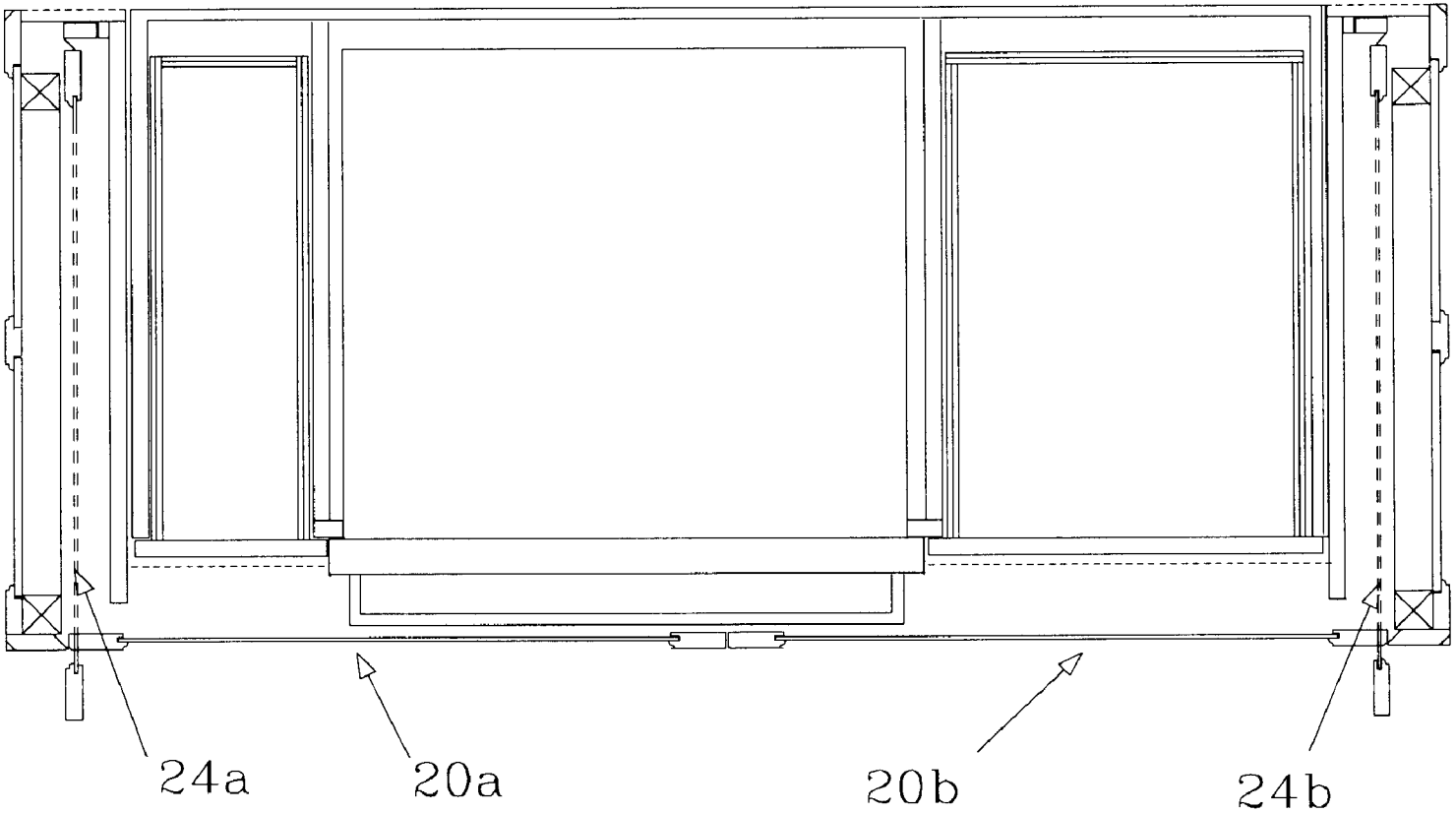
FIG. 2A is an top view of an alternative configuration of the presently disclosed apparatus for enclosing an appliance.
Figure 2B:
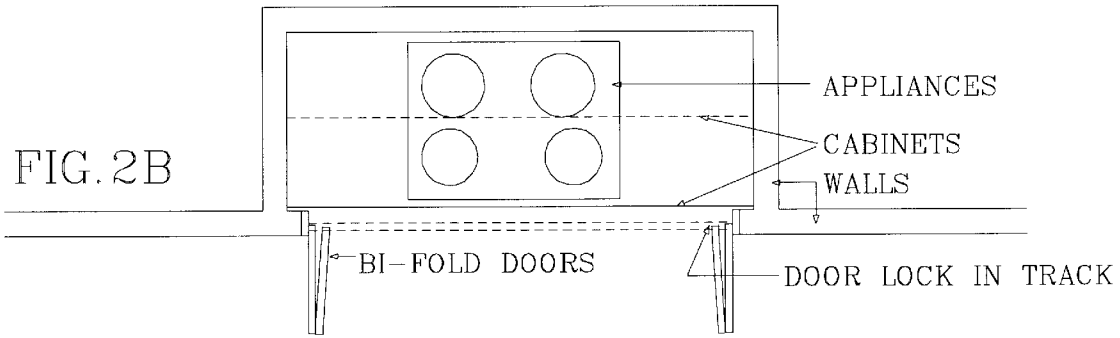
FIG. 2B is an alternative embodiment of the apparatus of FIG. 2A.
Figure 2C:
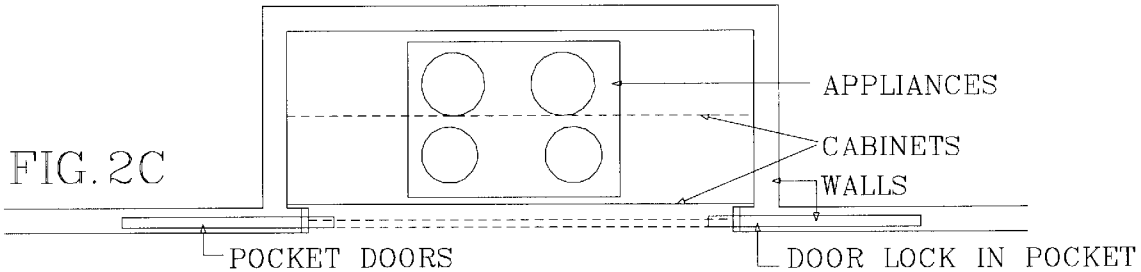
FIG. 2C is a further alternative embodiment of the apparatus of FIG. 2A.
Figure 2D:
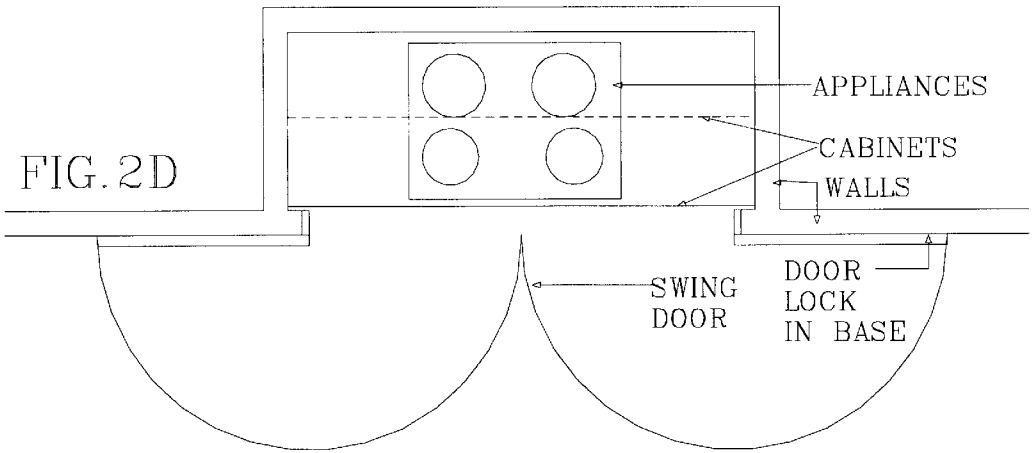
FIG. 2D is still another alternative embodiment of the apparatus of FIG. 2A.

FIG. 2A is a top view of the same configuration of the apparatus 10 showing the position of the flipper door panels 20*a* and 20*b* in the closed position (solid line) and in the open position (broken line). Specifically, in the open position the door panels 20*a* and 20*b* slide into pockets 24*a* and 24*b*, respectively, to reveal the appliance enclosed within apparatus 10. Alternate configurations for storing an appliance in an enclosure include, for example, a closet with bi-fold doors (FIG. 2B), a closet with pocket doors (FIG. 2C) or a closet with swing doors (FIG. 2D). Other enclosures with movable access members are contemplated as well. There are two types of controls that allow the appliances to be safely hidden in the enclosures. The following describes the controls required to hide ovens, for example.

Figure 3A:
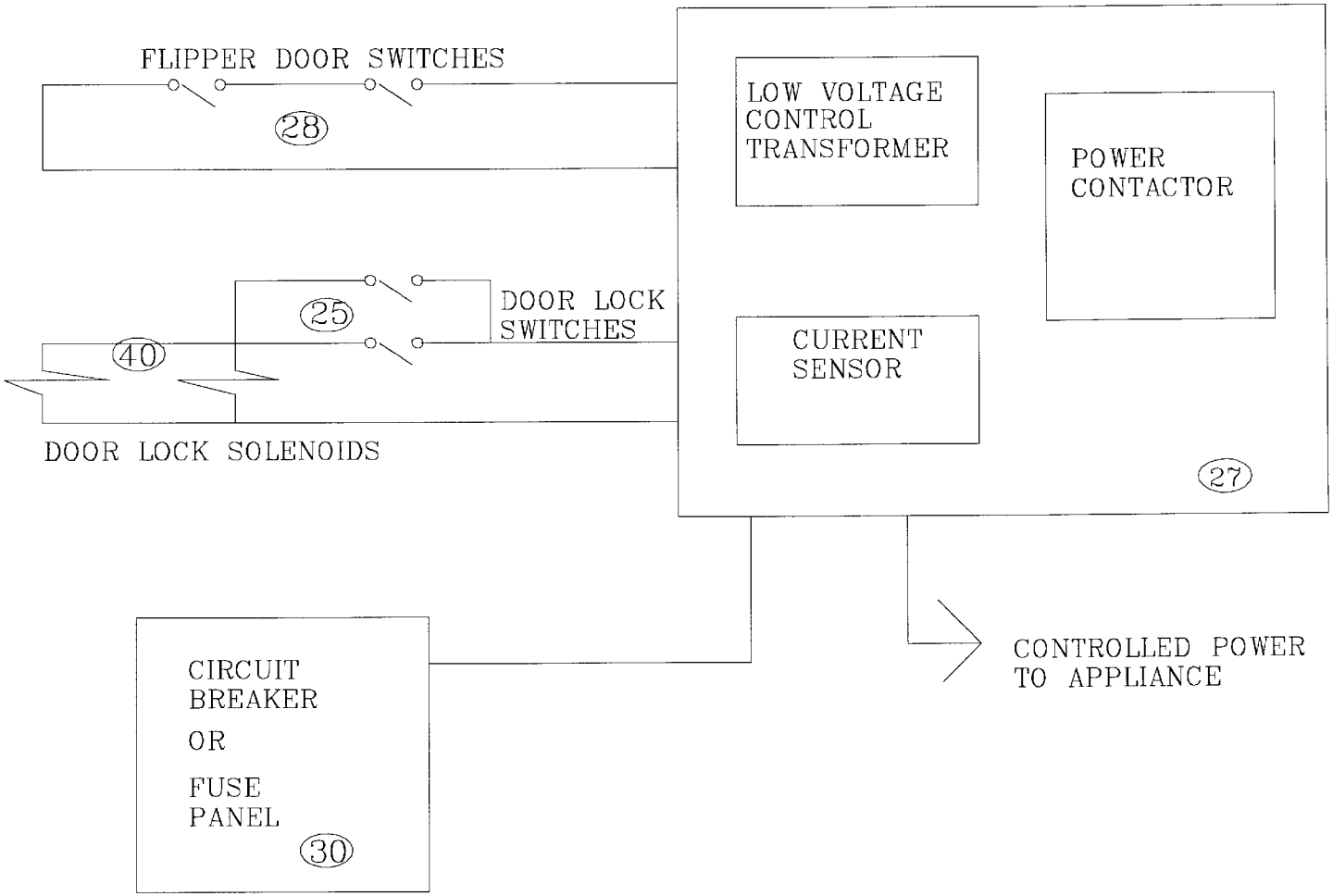
FIG. 3A is a block diagram of the circuit for shutting off power to the appliance once the door of the apparatus is closed.

A mechanical door lock in conjunction with electrical circuits prevent the door panels 20*a* and 20*b* from being closed while the appliance is in operation or while it is cooling, if cooling is critical to the appliance's integrity. These contingents are accomplished by the use of door switches, a locking mechanism, and a control panel connected between the building circuit breaker or fuse panel and the appliance. FIG. 3A is a block wiring diagram illustration of the circuit breaker/fuse panel 30, control panel 27, and accessory switches 25 and 28, and lock release solenoid 40.

Figure 3B:
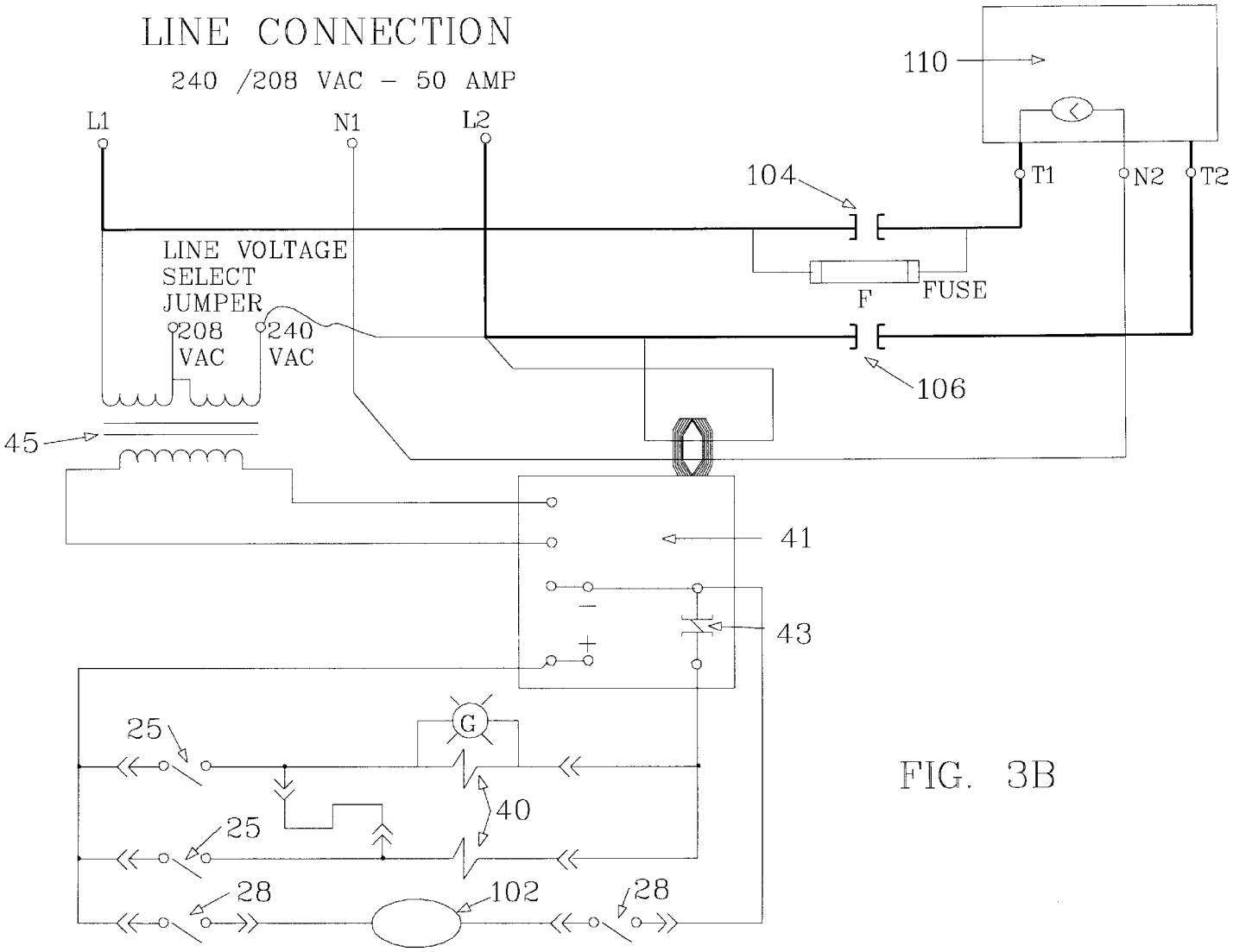
FIG. 3B is a schematic diagram of the circuit for shutting off power to the appliance once the door of the apparatus is closed.

Referring to FIG. 3B, the switches 28 sense movable access members such as flipper doors 20*a* and 20*b* in the full open position and allow the power contactor 102, to close contacts 104 and 106 to apply line voltage to an appliance 110, for example an oven or range. Although the presently described embodiment includes a pair of flipper doors, it is also within the scope of the present disclosure that a single access member, such as a door, panel or drawer could also be utilized without departing from the scope or spirit of the present disclosure.

The appliance 110 remains powered and operational as long as the flipper doors 20*a* and 20*b* are in the full open and locked position. When the doors 20*a* and 20*b* are opened and the appliance is turned on, a spring moves an armature or locking device in locking mechanism 23 which locks the doors 20*a* and 20*b* in place. When flipper doors 20*a* and 20*b* are to be closed, switches 25 are closed, which activates solenoids 40 for unlocking the doors 20*a* and 20*b*.

Figure 4A:
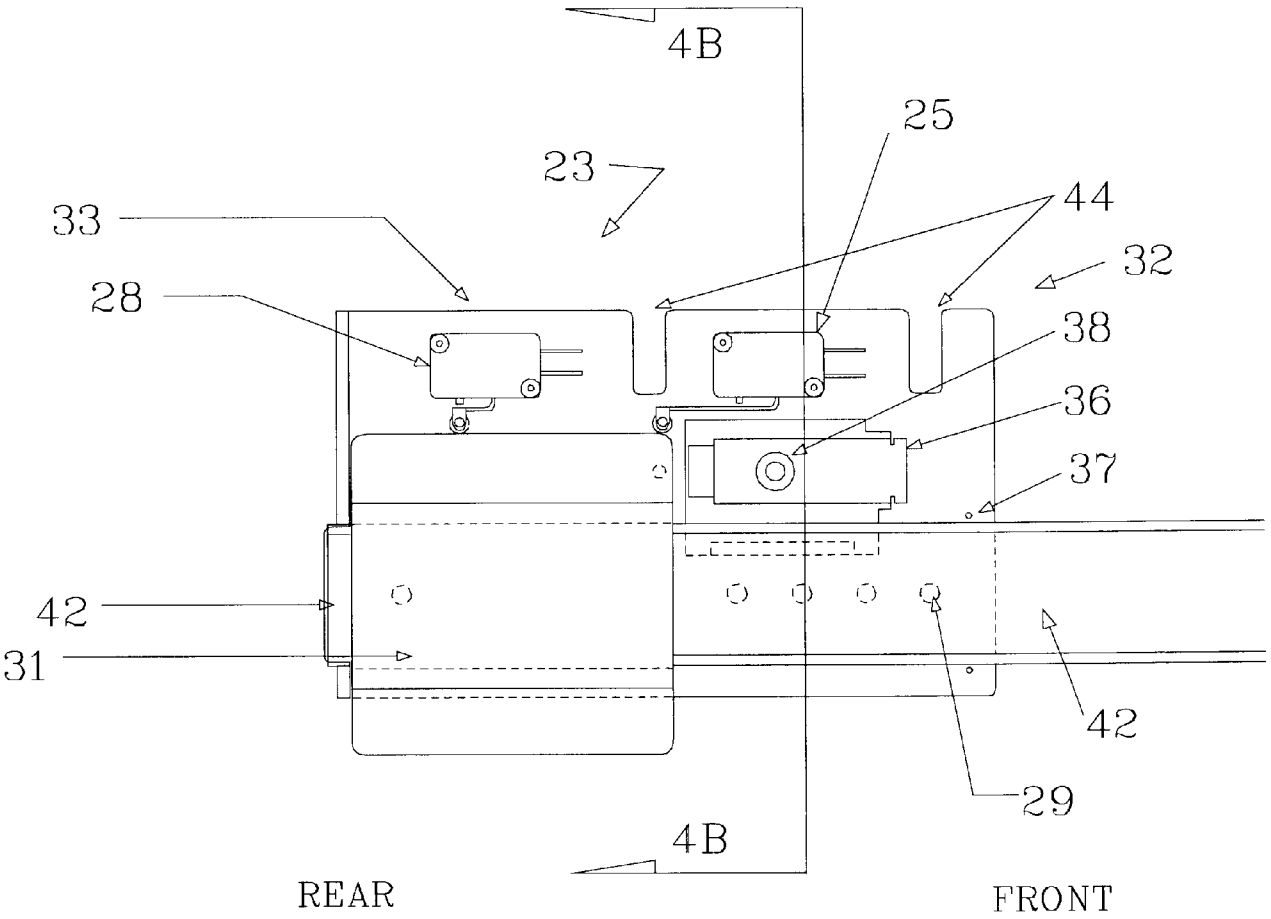
FIG. 4A is a door switch and door lock mechanism to lock doors and enable power to activate the enclosed appliance.
Figure 4B:
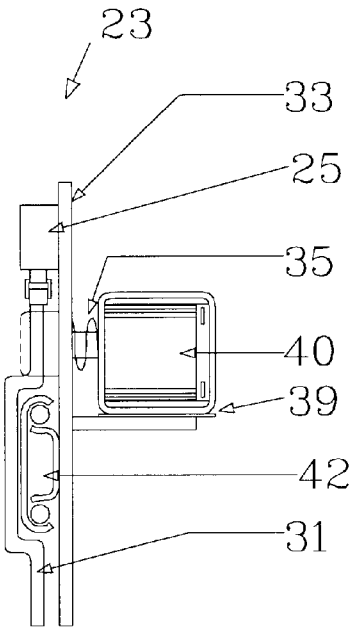
FIG. 4B is a cross-sectional view taken along section line 4B—4B in FIG. 4A.

This oven control uses a line current sensor 41 to determine if the heating elements or the cooling fan is energized. Either condition indicates heat is present and a cooling-down period is needed. Under these conditions, solenoids 40 are turned off thereby locking the doors in the full open position with the locking mechanism 23 as illustrated in FIG. 4A and 4B. Locking mechanism 23 is used only with an oven or range that can store heat after it is turned-off. Current sensor 41 senses the current draw by the oven or range and if the appliance is turned on, the current sensor located in the appliance's control panel 27 senses the current draw and the solenoid 40 is turned off. A spring 35 pushes the armature 36 in front of the mounting plate 31 to prevent closure of the doors 20*a* and 20*b*, as described above. The doors 20*a* and 20*b* will remain locked for a predetermined suitable period of time, e.g. approximately one-half hour after the appliance has ceased to use power. A transformer 45 is also included to reduce the power voltage to the appropriate level for the current sensor 41 and contactor 102. A fuse F can be connected across contacts 104 to provide power to the appliance's clock/timer.

The locking mechanism 23 holds the flipper door panels 20*a* and 20*b* in the open position for a predetermined time period, e.g., 30 minutes after the oven or range has been off for 30 minutes. Specifically, the locking mechanism 23 includes a spring or other actuating means which is controlled by sensing the current used by the appliance, e.g., the oven and the oven fan. The solenoid activated mechanism 32 is mounted on a mounting plate 33 which is mounted to a track 42 via mounting holes 29. The solenoid activated mechanism 32 includes a switch 25, an armature 36 and a solenoid shaft 38 which are positioned on a mounting plate 39.

In operation, the door mounting plate 31 slides on track 42 to activate switch 25 causing the solenoid plunger 40 to retract the armature 36 into an unlocked position. The mounting plate 31 travels to a stopping point and trips switch 28, energizing the power contactor in the control box 27 and subsequently supplies power to the appliance. If the appliance is turned on, a current sensor located in the appliance's control panel 27 senses the current draw and the solenoid 40 is turned off. A spring 35 pushes the armature 36 in front of the mounting plate 31 to prevent closure of the door panel 20*a*. Door panel 20*a* will remain locked for a predetermined suitable period of time, e.g. approximately one-half hour after the appliance has ceased to use power.

After the predetermined period of time, the time delay circuit supplies power to solenoid 40, which pulls plunger 38 and deactivates the armature 36 (FIG. 4A). The door panel or movable access member 20*a* can then be closed. During closure, the mounting plate 31 releases switch 25 to deactivate the solenoid 40.

The solenoid activated mechanism 32 is connected to a power source via wire channels 44. With respect to door panel 20*b*, another hardware configuration identical to the hardware configuration 23 illustrated by FIGS. 4A and 4B is utilized to perform the same function. Both doors 20*a* and 20*b* have to be retracted for the above systems to work.

This locking mechanism 23 which is illustrated by FIGS. 4A and 4B is particularly useful for self-cleaning ovens. This type of oven typically utilizes small fans that are intended to cool the digital control panel after the heating cycle has been completed and, therefore, operate long after the oven has turned off. Thus, cutting power by closing door panels 20*a* and 20*b* would not allow the oven to complete the cleaning cycle giving rise to the possibility that the oven could be damaged. To prevent this from occurring, locking mechanism 23 locks door panels 20*a* and 20*b*. The door panels 20*a* and 20*b* become unlocked after a certain time period has elapsed after the residual fan or oven is off. The time lag after all power requirements have ceased allows the oven to heat up and activate or re-activate the fan, thus activating another predetermined time period, e.g., one-half hour after the fan shuts off the second time to allow the appliance to cool before door panels 20*a* and 20*b* are permitted to be closed.

Figure 4C:
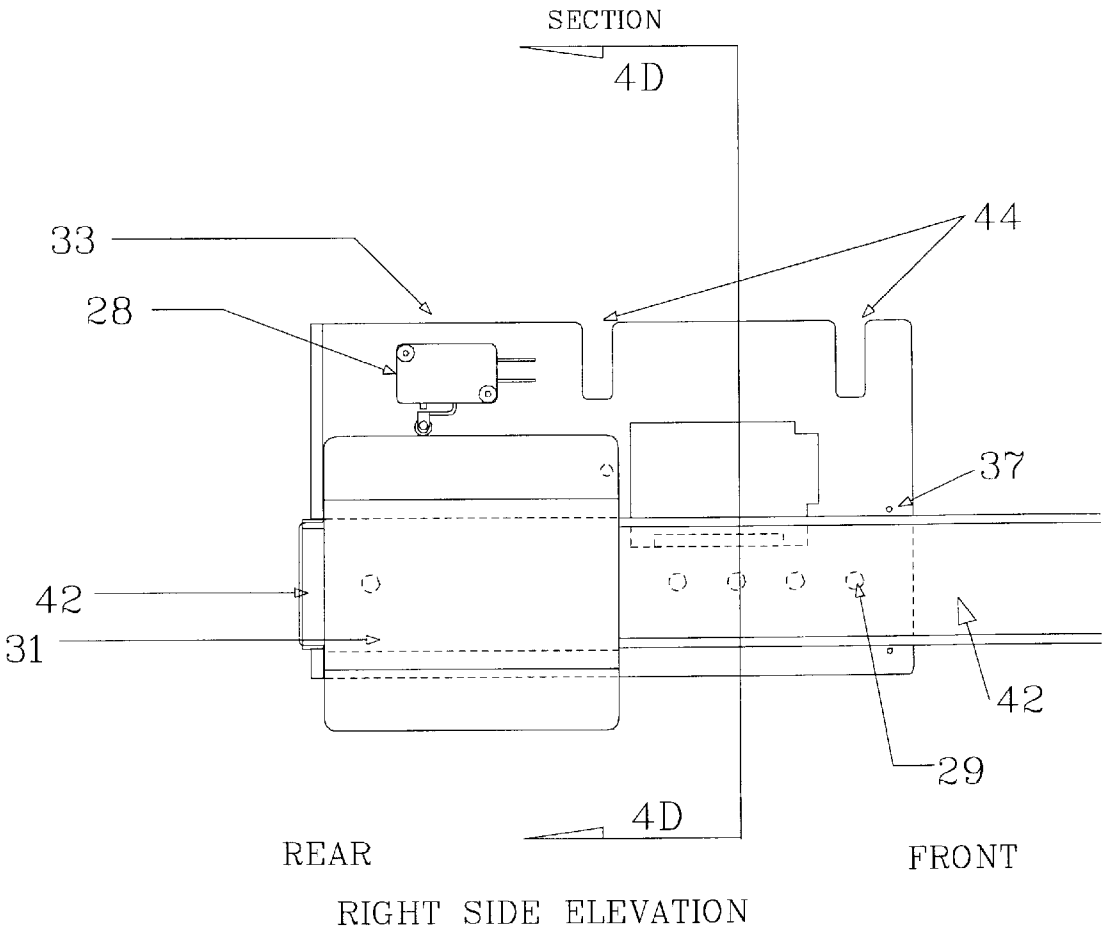
FIG. 4C is a door switch assembly which enables power to activate the enclosed appliance.
Figure 4D:
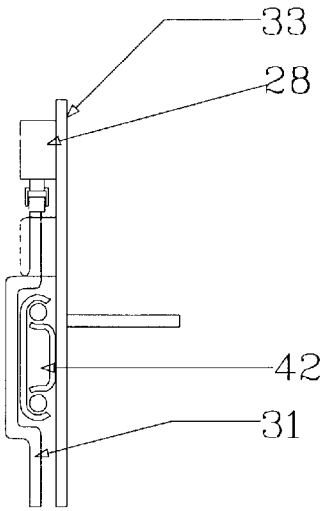
FIG. 4D is a cross-sectional view taken along section line 4D—4D in FIG. 4C.

The second control is used for microwave ovens, cooktops, dishwashers and other devices that do not store heat of sufficient quantities that could damage the appliance if the flipper doors were closed at any point in the operating cycle. This control, is similar to that illustrated in the embodiment of FIG. 3A, but omits the current sensor, the door lock solenoids 40, and the door lock switches 25. FIG. 4C diagrams this switch 28, which is activated by the mounting plate 31 which is attached to the flipper doors. No locking mechanism or current sensor is included for this control, but in all other ways, it performs like the previously described oven switch.

Figure 5A:
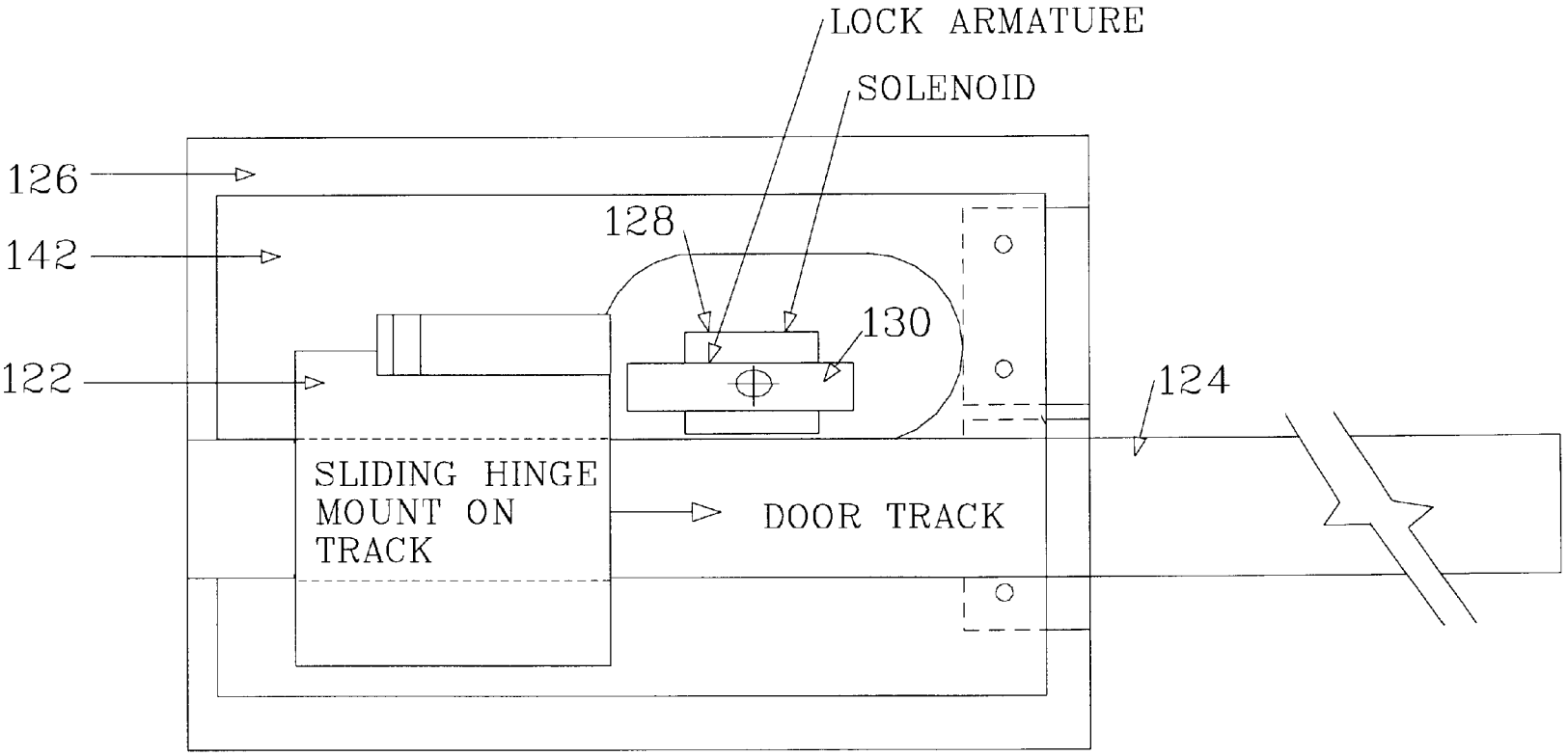
FIG. 5A is a front view of an armoire door track system with a locking device.
Figures 5B, 5C:
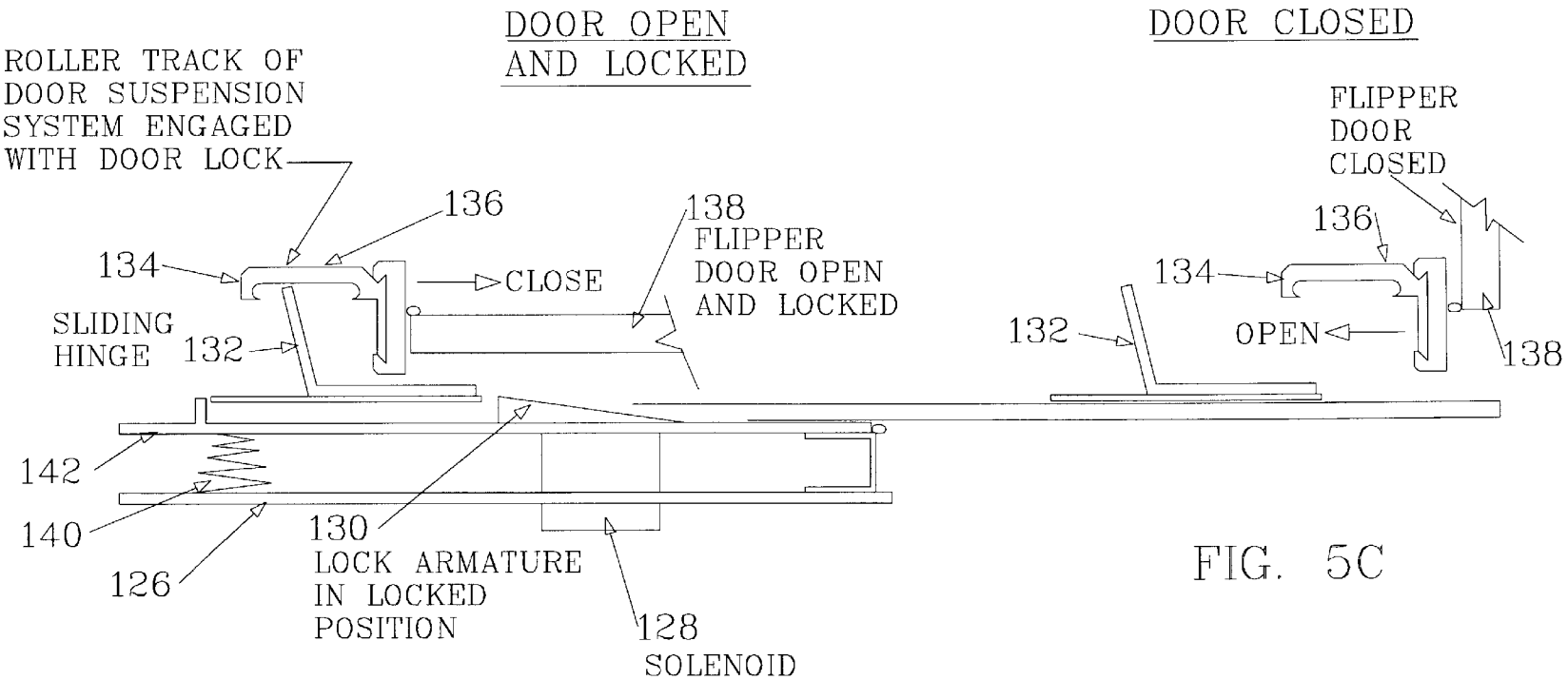
FIG. 5B is a top view of the armoire door track system showing the locking device in a locked position.
FIG. 5C is a top view of the armoire door track system showing the door closed.

Referring to FIGS. 5A–C, another embodiment of the locking mechanism is adapted for use with armoires or other enclosure types having large doors wherein the only a small portion or a single piece of hardware follows a track. The track system for opening and closing, for example, armoire doors includes a sliding hinge plate 122 disposed in a door track 124. An adapter base 126 attaches to the door lock mechanism 23. An armature 130 is movable between a locked position and a released position. When in the locked position, the sliding hinge plate 122 is prevented from moving by the armature 130. In addition, a bracket 132 is mounted on the sliding hinge 122 which interferes with a latching portion 134 of a roller track 136 mounted to an armoire door 138. The interference between the latching portion 134 and the bracket 132 prevents the closure of the armoire door 138. When in the released position, the armature 130 is movable to permit the sliding hinge plate 122 to slide along the door track and open the door. The bracket 132 is disengaged from the latching portion 134. Other aspects of the operation for armoire doors or equivalent types of enclosures are similar as mentioned hereinabove.

It is envisioned that the apparatus of the present disclosure may be incorporated in an enclosure which may include other sub-assemblies such as drawers, shelving, sinks, lighting, etc. that combine together in various ways to produce functional kitchen furniture, cabinetry, or other built-in or relocatable appliance concealing constructions.

It will be understood that various modifications can be made to the various embodiments of the presently disclosed apparatus for enclosing appliances without departing from its spirit and scope. For example, various shapes of the enclosure are contemplated, as well as various types of construction materials. Also, various modifications may be made in the structural configuration of the enclosure and the configuration of the electronic components. Therefore, the above description should not be construed as limiting the invention but merely as presenting preferred embodiments of the invention. Those skilled in the art will envision other modifications within the scope and spirit of the present invention.

What is claimed is:

1. An apparatus for enclosing appliances, which comprises:

an enclosure having an access member movable between an open configuration and a closed configuration;

a power supply mechanism disposed within the enclosure and adapted to interface with the power supply of the appliance supply power to the appliance when the access member is in the open configuration and disconnect power to the appliance when the access member is in the closed configuration; and an access member locking mechanism disposed within the enclosure which is operable between a locked condition to lock the access member in the open configuration in response to the operation of the appliance and a released condition to permit movement of the access member to the closed configuration.

2. The apparatus for enclosing appliances as recited in claim 1 wherein the access member is a door.

3. The apparatus for enclosing appliances as recited in claim 1 wherein the power supply mechanism includes at least one movable access member switch.

4. The apparatus for enclosing appliances as recited in claim 3, which further comprises a plurality of access members, each having an associated access member switch in series such that when all moveable access members are in the open configuration power is supplied to the appliance.

5. An apparatus for enclosing appliances, which comprises:

at least one access member;

at least one access member switch;

a power supply interface which includes a contactor for making at least one contact point to supply power to an appliance when the at least one access member is in an open configuration and disconnect power to the appliance when the at least one movable access member is in the closed configuration wherein the at least one access member switch is opened corresponding to the closed configuration and the at least one access member switch is closed corresponding to the open configuration; and a plate attached to the at least one access member for closing the at least one access member switch when the at least one access member is fully opened.

6. The apparatus for enclosing appliances as recited in claim 5, which further comprises:

at least one enabling switch; and a locking mechanism having an actuation means for moving a locking device between a lock position when the at least one enabling switch is open and a release position when the at least one enabling switch is closed to respectively lock or release the at least one movable access member.

7. The apparatus for enclosing appliances as recited in claim 6 wherein the actuation means includes a spring and the locking device includes a shaft actuated by the spring, the shaft configured and dimensioned to fit in a corresponding opening in the at least one access member such that the shaft locks the at least one access member in the fully opened position when actuated to move into the opening and the access member is released when the shaft is retracted.

8. The apparatus for enclosing appliances as recited in claim 6, which further comprises a current sensor for sensing current through a power line to the appliance such that if current is flowing, the actuation means maintains the locking device in the lock position.

9. The apparatus for enclosing appliances as recited in claim 8 wherein the current sensor maintains the locking device in the lock position for a predetermined amount of time after the appliance is turned off.

10. The apparatus for enclosing appliances as recited in claim 8, which further comprises a transformer for adjusting a voltage to the contactor and the current sensor.

11. The apparatus for enclosing appliances as recited in claim 5, which further comprises a fuse connected across the at least one contact point.

12. The apparatus for enclosing appliances as recited in claim 5, which further comprises a plurality of movable access members, each having an associated access member switch connected in series such that when all access members are in the open configuration power is supplied to the appliance.

13. A lock circuit for locking a movable access member on an enclosure, which comprises:

at least one access member switch connecting between a power terminal and a contactor, the contactor for making at least one contact point when a movable access member of an enclosure is closed, the at least one contact point connecting segments of a power line for supplying power to an appliance at least partially enclosed by the enclosure when the movable access member is closed;

at least one enabling switch connecting between the power terminal and actuation means, the actuation means for moving a locking device between a lock position when the at least one enabling switch is opened and a release position when the at least one enabling switch is closed to respectively lock or release a movable access member;

a current sensor for sensing current through the power line such that if current is flowing actuation means maintains the locking device in the lock position; and a plate attaching to the movable access member, the plate being configured and dimensioned to engage and close the at least one access member switch.

14. A lock circuit for locking a movable access member as recited in claim 13 wherein the current sensor maintains the locking device in the lock position for a predetermined amount of time after the appliance is turned off.

15. A lock circuit for locking a movable access member as recited in claim 13 wherein the locking device includes a shaft, the shaft configured and dimensioned to fit in a corresponding opening in the plate such that the shaft locks the movable access member in the fully opened position when actuated to move into the opening and the movable access member is released when the shaft is retracted.

16. A lock circuit for locking a movable access member as recited in claim 13, which further comprises a fuse connected across the at least one contact point of the power line.

17. A lock circuit for locking a movable access member as recited in claim 13, which further comprises a transformer connecting between a line voltage and the power terminal for adjusting a voltage to the current sensor.

18. A lock circuit for locking a movable access member as recited in claim 13, wherein the at least one access member switch comprises a plurality of movable access member switches for attachment to a plurality of movable access members, the plurality of movable access member switches being connected in series such that when all the plurality of movable access members are in the open configuration power is supplied to the appliance.

* * * * *